US007101589B1

(12) United States Patent
Hawkins

(10) Patent No.: US 7,101,589 B1
(45) Date of Patent: Sep. 5, 2006

(54) MAGNESIUM CORROSION PROTECTION WITH ADHESION PROMOTER

(75) Inventor: James H. Hawkins, Phoenix, AZ (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 11/168,065

(22) Filed: Jun. 28, 2005

(51) Int. Cl.
*B05D 1/18* (2006.01)
*B05D 3/00* (2006.01)
*B05D 3/10* (2006.01)

(52) U.S. Cl. ..... 427/309; 427/327; 427/409; 427/435

(58) Field of Classification Search ..... 428/649, 428/626, 625, 624, 457, 666, 418, 448; 427/307, 427/309, 327, 328, 407.1, 409, 404, 435; 205/243, 290, 283, 205, 210; 74/606 R
See application file for complete search history.

(56) References Cited

U.S. PATENT DOCUMENTS 5,021,301 A * 6/1991 Nakakoji et al. ..... 428/659

FOREIGN PATENT DOCUMENTS

JP 11-172202 * 6/1999

* cited by examiner

*Primary Examiner*—Michael E. Lavilla
(74) *Attorney, Agent, or Firm*—Shimokaji & Associates, P.C.

(57) ABSTRACT

A method for protecting from corrosion an element comprised of magnesium or a magnesium alloy comprises applying an adhesion promoter after applying a chromate solution to a surface of the element, whereby the chromate solution creates a corrosion-resistant chromate layer on the surface. The method further includes applying an organic coating, such as a resin seal, over the adhesion promoter so as to provide a seal from water and corrosive elements. The adhesion promoter provides improved adhesion between the chromate layer and the organic coating. Corrosion may be removed from the magnesium element before the application of the chromate solution.

10 Claims, 5 Drawing Sheets

MAGNESIUM CORROSION PROTECTION WITH ADHESION PROMOTER

GOVERNMENT RIGHTS

This invention was made with Government support under contract DAAH23-00-C-0001 awarded by the U.S. Army. The Government has certain rights in this invention.

BACKGROUND OF THE INVENTION

The present invention generally relates to corrosion protection systems and, more particularly, to corrosion protection for magnesium materials using an adhesion promoter.

The use of magnesium and magnesium alloy parts in vehicles is common due to the lightweight qualities of magnesium and the ease of casting the metal. As such, parts such as gearboxes for vehicles such as fighter aircraft and helicopters are often made using magnesium. This metal, however, does not come without its drawbacks. Magnesium corrodes much more easily than other metals used for vehicle parts. Water and salt from rain, salt fog or salt spray can have a negative corrosive affect on parts made of magnesium. As a result, these magnesium parts must be serviced or replaced more often than parts made from other metals. Consequently, vehicles and components that include magnesium parts can experience line shortages or suspensions as the parts are serviced or replaced. Corroded magnesium parts typically go through a repair process wherein corroded areas of the magnesium parts are removed or abraded and the remaining surface is treated with anti-corrosion or corrosion-inhibiting substances.

One approach to the corrosion problem is to use a chromate conversion process to treat the surfaces of magnesium parts that are prone to corrosion. Chromate conversion processes introduce chromium into the outer surface of magnesium parts. Chromium possesses anti-corrosion properties and therefore aids in the purpose of fighting corrosion in magnesium parts. The chromate conversion process does not keep out those elements that cause corrosion; it simply inhibits corrosion along the treated surfaces of the magnesium parts.

Another approach to the problem of corrosion in magnesium parts is to apply a resin seal on those magnesium parts that corrode easily. Resin seals provide an outer shell and waterproof seal that helps to repel and keep out those atmospheric elements that cause corrosion, such as water and salt. Thus, resin seals provide a measure of corrosion resistance to magnesium parts. Resin seals, however, simply keep out those elements that cause corrosion; they do not inhibit corrosion on magnesium surfaces.

Yet another approach to the problem of corrosion in magnesium parts includes the use of both a chromate conversion process and resin seals. In this approach, the affected magnesium parts undergo the chromate conversion process and subsequently a resin seal is applied over the chromate surfaces. Observations, however, show low wet adhesion between the resin seal and the chromate surface coating, leading to peeling or blistering of resin seal and corrosion of the magnesium substrate. Thus making this combination of elements inadequate for corrosion resistance.

As can be seen, there is a need for an improved corrosion protection system that both inhibits corrosion in magnesium parts and denies entry of corrosive materials into magnesium materials. Moreover, there is a need for a method for repairing corroded magnesium parts by removing existing corrosion and restoring corrosion resistance in order to place the parts in a proper form for reuse.

SUMMARY OF THE INVENTION

In one aspect of the present invention, method for protecting a magnesium element from corrosion comprises applying a chromate layer to a surface of the magnesium element and subsequently applying an adhesion promoter over the chromate layer. The method further comprises applying an organic coating over the adhesion promoter such that the adhesion promoter provides adhesion between the chromate layer and the organic coating.

In another aspect of the present invention, a system for protecting a magnesium element from corrosion comprises a chromate layer for applying to a surface of the magnesium element and an adhesion promoter for applying over the chromate layer. The system further comprises an organic coating for applying over the adhesion promoter such that the adhesion promoter provides improved adhesion between the chromate layer and the organic coating.

In still another aspect of the present invention, a method for protecting a vehicle gearbox composed of magnesium or magnesium alloy from corrosion comprises removing corrosion and paint from the gearbox and immersing the gearbox in a chromate solution so as to create a chromate layer on a surface of the gearbox. The method further comprises applying an adhesion promoter over the chromate layer on the surface of the gearbox and applying an organic coating over the adhesion promoter wherein the adhesion promoter provides improved adhesion between the chromate layer and the organic coating.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Broadly, the present invention provides a method and system for repairing corroded magnesium or magnesium alloy parts, such as gearboxes for fixed-wing fighter aircraft and helicopters, by removing existing corrosion and restoring corrosion resistance. The method of one embodiment of the present invention protects a magnesium element from corrosion by applying a chromate solution to a surface of the element, thereby creating a chromate layer on the surface of the magnesium element. Optionally, the corroded elements of the magnesium parts may be removed before application of the chromate solution. Next, an adhesion promoter may be applied over the chromate layer. The method may further include the application of an organic coating or resin, such as an epoxy-phenolic or epoxy-amino resin, over the adhesion promoter, wherein the adhesion promoter provides improved adhesion between the chromate solution and the organic coating.

One embodiment of the present invention provides corrosion resistance through the use of the chromate layer denial of entry of corrosive elements through the use of the resin seal and structural integrity between the chromate layer and the resin seal through the use of the adhesion promoter. This combination of elements provides improved corrosion and water resistance and increases the service life of magnesium and magnesium alloy parts for vehicles such as fighter planes and helicopters. Further, the corrosion protection system of an embodiment of the present invention meets engineering requirements for dry and wet coating adhesion for magnesium and magnesium alloy parts. The corrosion protection system of an embodiment of the present invention differs from the prior art in that it includes the use of an adhesion promoter to increase the adhesion between a chromate layer and an organic coating. The prior art discloses only the use of an organic coating over a chromate layer, which, due to low adhesion between the two substrates, is not adequate for corrosion and water protection due to separation of the resin seal from the chromate layer or blistering of the layers.

Figure 1:
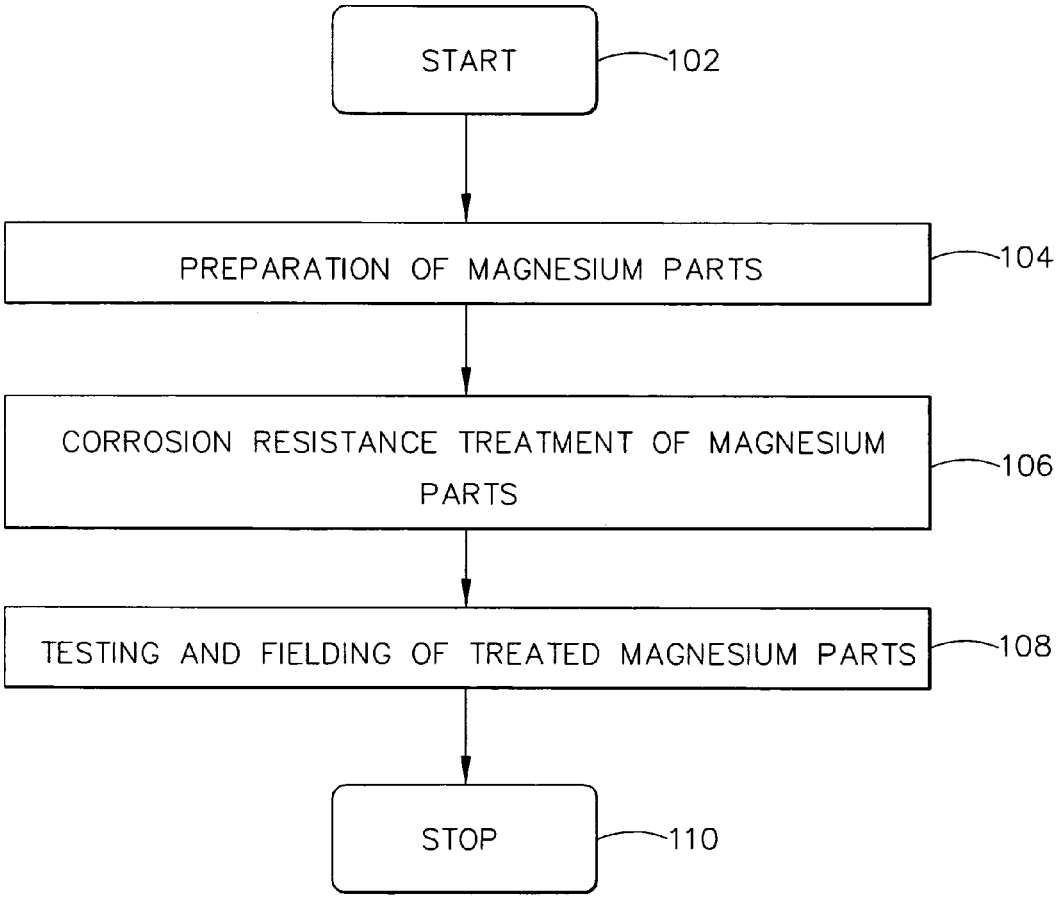
FIG. 1 is a flow chart showing the overall corrosion protection process according to one embodiment of the present invention.

Referring now to FIG. 1, a flow chart shows the overall corrosion protection process according to one embodiment of the present invention. The flow of FIG. 1 begins with step 102 and moves directly to step 104. In step 104, magnesium elements may be prepared by removing existing corrosion. A magnesium element, shown as magnesium element 400 in FIG. 4A below, may include any part or component that comprises magnesium or a magnesium alloy. Magnesium elements can be, for example, a gearbox for a fixed aircraft, such as an F-16, or a gearbox for a helicopter such as the AH-64 Apache helicopter used by the U.S. Army. In one embodiment, the gearbox may be the housing assembly for the tail-rotor gearbox for the Apache helicopter.

In step 106, the magnesium elements may be treated for corrosion resistance using a variety of materials. In step 108, the repaired and re-engineered parts of steps 101–106 above may be acceptance tested and subsequently re-introduced into service with the increased corrosion resistance inculcated by the process of FIG. 1. In one embodiment of the present invention, step 108 may further include the inspection of the magnesium elements and the application of an additional primer and top coat over the organic coating for added corrosion protection. In step 110, the flow of FIG. 1 stops.

Figure 2:
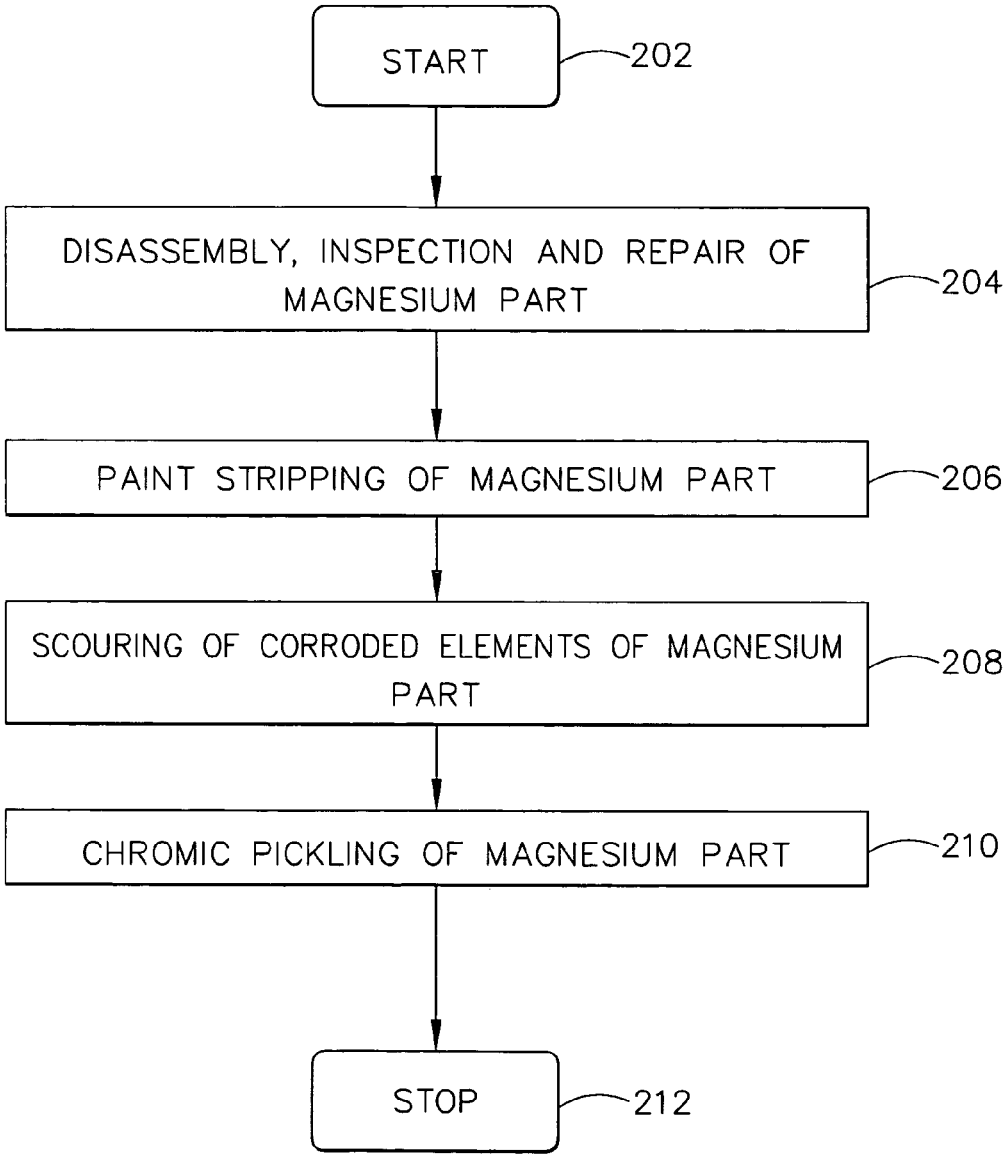
FIG. 2 is a flow chart showing the corrosion removal process according to one embodiment of the present invention.

FIG. 2 is a flow chart showing the corrosion removal process according to one embodiment of the present invention. The process of FIG. 2 provides more detail about the process of removing corrosion and preparing the damaged magnesium elements, as described in step 104 of FIG. 1 above. As explained above, a magnesium element may include any part or component that comprises magnesium or a magnesium alloy. The flow of FIG. 2 begins with step 202 and moves directly to step 204.

In step 204, the magnesium elements may be disassembled, fluorescent or liquid penetrant inspected, and structurally repaired. In the case of a tail-rotor gearbox for an Apache helicopter, all parts of the gearbox structure may be disassembled so as to expose those areas of the gearbox affected by corrosion and slated for corrosion resistance treatment. Disassembly may include cleaning and degreasing of the structures using, for example, trichloroethylene or inhibited alkaline cleaner. Florescent and liquid penetrant inspection are well known processes in the art for detecting minute cracks and other aberrations in surfaces that may be repaired. Any structural defects may be repaired or otherwise replaced. This may include removal and blending of nicks, gouges, scratches and dents and reworking discrepant holes.

Next, in step 206, any paint, organic coating or primer on the exposed surfaces of the magnesium element may be stripped or removed. In one embodiment, removal occurs through the use of a chemical peeling process whereby a decomposition chemical, such as an alkaline chemical peel solution, may be applied to the surface of the magnesium element and the paint, organic coating or primer on the exposed surfaces of the magnesium element dissolves or loses integrity. In another embodiment, removal occurs through the use of plastic media, which is a process well-known it the art whereby grain-like particles of plastic material are shot at the surfaces of the magnesium elements at high speed, so as to remove any unwanted substrates.

Figure 3:
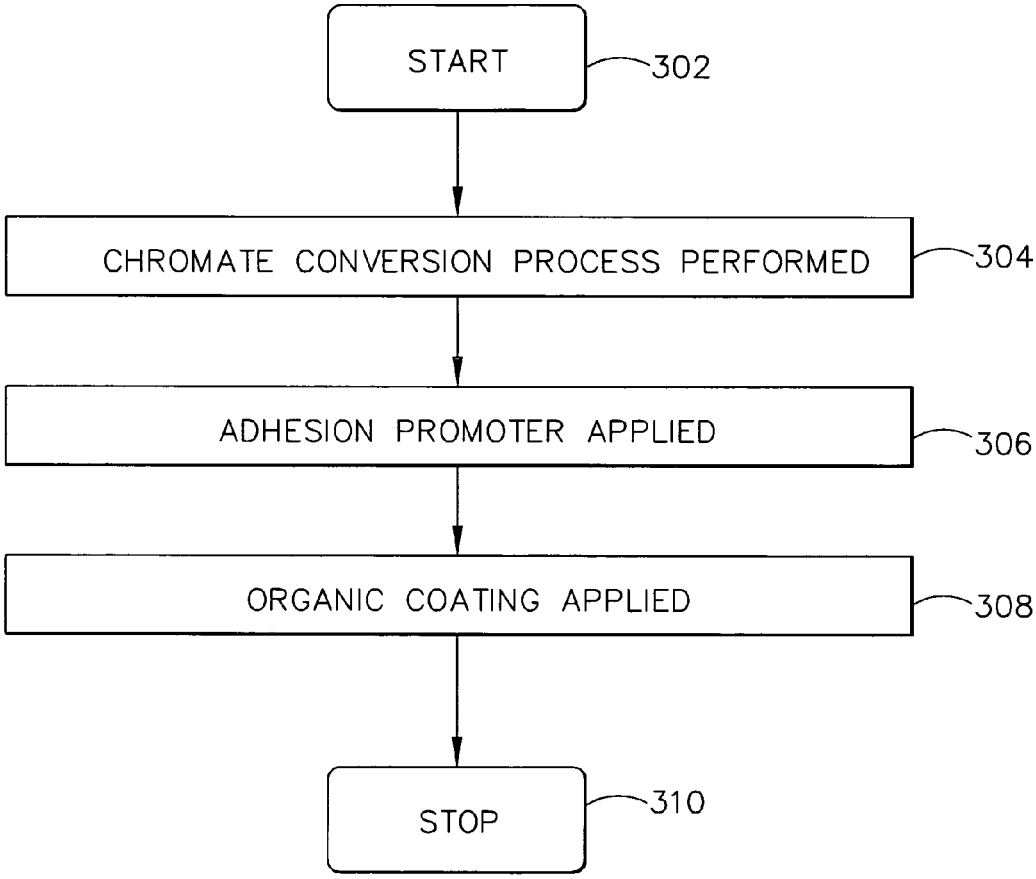
FIG. 3 is a flow chart showing the corrosion resistance treatment process according to one embodiment of the present invention.

Optionally, a confirmatory fluorescent or liquid penetrant inspection operation may be performed after steps 202–206. Then, in step 208, the magnesium element may be scrubbed, scoured or abraded with an abrasive pad or other abrasive element. In one embodiment, a Scotch Brite scouring pad available from the 3M Corporation of St. Paul, Minn. may be used for step 208. Next, in step 210, a chromic acid pickle may be applied to the magnesium element. Pickling in chromic acid is a time-tested process for arresting corrosion and for removing oxides and corrosion products from magnesium when no dimensional loss can be tolerated. This process may also remove previously applied chromate and anodic chemical treatments, such as the Dow 7 and Dow 17 solutions available from the Dow Chemical Company of Midland, Mich. Other solutions that may be used for the chromic pickle include sodium dichromate, or chromic-nitric-hydrofluoric acid. In step 212, the flow of FIG. 2 stops FIG. 3 is a flow chart showing the corrosion resistance treatment process according to one embodiment of the present invention. The process of FIG. 3 provides more detail with regard to the process of providing corrosion resistance treatment to damaged magnesium elements, as described in step 106 of FIG. 1 above. The flow of FIG. 3 begins with step 302 and moves directly to step 304. In step 304, the magnesium elements may be chromated using a chromate conversion process. In one embodiment, the chromate conversion process may be performed by immersing the magnesium element in a container filled with a chromate solution, such as Dow 7, for a period of time of about 10 minutes.

FIG. 3 is a flow chart showing the corrosion resistance treatment process according to one embodiment of the present invention. The process of FIG. 3 provides more detail with regard to the process of providing corrosion resistance treatment to damaged magnesium elements, as described in step 106 of FIG. 1 above. The flow of FIG. 3 begins with step 302 and moves directly to step 304. In step 304, the magnesium elements may be chromated using a chromate conversion process. In one embodiment, the chromate conversion process may be performed by immersing the magnesium element in a container filled with a chromate solution, such as Dow 7, for a period of time of about 10 minutes This chromate treatment is a time-tested process that causes no appreciable dimensional change and provides corrosion protection on magnesium and magnesium alloy parts. The result of the chromate conversion process may be the creation of a layer of magnesium chromate along the exposed surfaces of the magnesium element. This chromate layer provides corrosion resistance. Observations have shown that the chromate layer may include some cracks that extend through the chromate layer to the magnesium element below.

In step 306, an adhesion promoter may be applied to the magnesium element over the chromate layer. In one embodiment, the adhesion promoter may be applied by immersing the magnesium element in a container filled with the adhesion promoter. In another embodiment, the adhesion promoter may be applied by spraying or otherwise painting of the magnesium element with the adhesion promoter. In another embodiment, the adhesion promoter may be the PreKote product available from Pantheon Chemical Co. of Phoenix, Ariz.

The adhesion promoter provides added adhesion between the chromate layer and any organic coating later applied, such as a resin seal. The adhesion promoter may penetrate into bare areas or any cracks in the chromate layer that extend through the chromate layer to the magnesium element below. Improved adhesion between the resin seal and the chromate surface coating eliminates or reduces separation of the resin seal from the chromate layer or blistering of resin seal or the chromate layer from each other, thereby increasing corrosion resistance. Further, the adhesion promoter improves the wet adhesion resistance (water resistance) of the corrosion protection system.

In step 308, an organic coating may be applied to the magnesium element over the adhesion promoter. In one embodiment, the organic coating may be applied by immersing the magnesium element in a container filled with the organic coating. In another embodiment, the organic coating may be applied by spraying or otherwise painting of the magnesium element with the organic coating. The organic coating may be a resin seal or an epoxy-phenolic or epoxy-amino resin seal. In one embodiment, the organic coating may be the Low Cure Rock Hard product or the Regular Rock Hard product available from Indestructible Paint, Inc. of Milford, Conn.

The organic coating may provide an outer shell and waterproof seal (of about 0.001 to about 0.003 inch thickness) that helps to deny entry to those atmospheric elements that cause corrosion, such as water and salt. The organic coating may further fill any cracks in the chromate layer that extend through the chromate layer to the magnesium element below. Thus, organic coatings such as resin seals provide a measure of corrosion resistance to magnesium parts. In step 310, the flow of FIG. 3 stops.

Figure 4A:
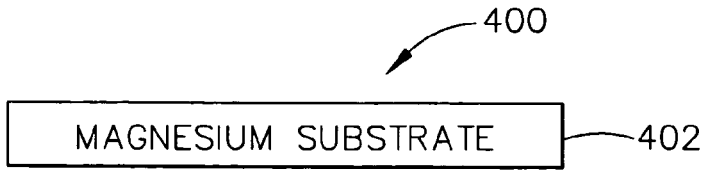
FIG. 4A is a block diagram showing a cross-section of a magnesium element before the chromate conversion process has been executed, according to one embodiment of the present invention.
Figure 4B:
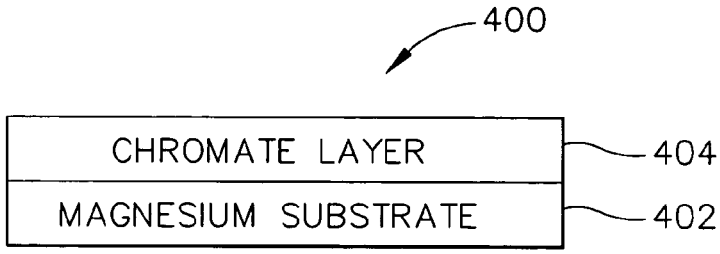
FIG. 4B is a block diagram showing a cross-section of the magnesium element after the chromate conversion process has been executed, according to one embodiment of the present invention.

FIGS. 4A–4D are block diagrams showing a cross-section of a magnesium element 400 undergoing the corrosion resistance treatment process as described in FIG. 3 above according to one embodiment of the present invention. FIG. 4A is a block diagram showing a cross-section of a magnesium element 400 before the chromate conversion process has been executed. Layer 402 shows a cross-section of the magnesium element 400, comprising magnesium or a magnesium alloy part. FIG. 4B is a block diagram showing a cross-section of the magnesium element 400 after the chromate conversion process has been executed. The result of the chromate conversion process may be the creation of a layer of magnesium chromate 404, i.e., a chromate layer, along the exposed surfaces of the magnesium substrate layer 402. The chromate layer 404 provides corrosion resistance.

Figure 4C:
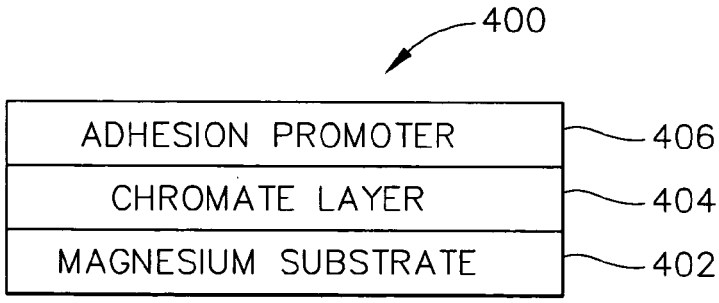
FIG. 4C is a block diagram showing a cross-section of the magnesium element after an adhesion promoter is applied to the magnesium element, according to one embodiment of the present invention.

FIG. 4C is a block diagram showing a cross-section of the magnesium element 400 after an adhesion promoter may be applied to the magnesium element 400 over the chromate layer 404. The result of the adhesion promoter application may be the creation of an adhesion promoter layer 406 over the chromate layer 404. The adhesion promoter layer 406 provides increased adhesion between the chromate layer 404 and an organic coating that may be applied later. The adhesion promoter penetrates through cracks and bare areas in the chromate layer to the base magnesium. By attaching to the bare magnesium as well as the chromate layer, improved adhesion is obtained when the resin seal is applied. Improved corrosion protection and water resistance results from improved adhesion of the resin seal to the chromate layer, especially in the cracks and bare areas.

Figure 4D:
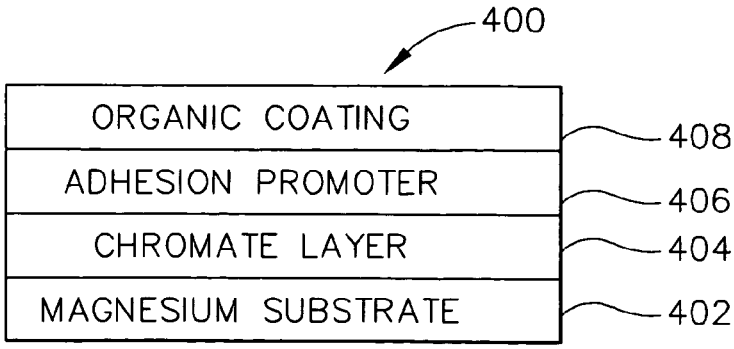
FIG. 4D is a block diagram showing a cross-section of the magnesium element after an organic coating is applied to the magnesium element, according to one embodiment of the present invention.

FIG. 4D is a block diagram showing a cross-section of the magnesium element 400 after an organic coating may be applied to the magnesium element 400 over the adhesion promoter layer 406. The result of the organic coating application may be the creation of an organic coating layer 408 over the adhesion promoter layer 406. The organic coating layer 408 provides a corrosion resistant seal over the magnesium element 400 to deny entry to those atmospheric elements that cause corrosion.

Figure 5:
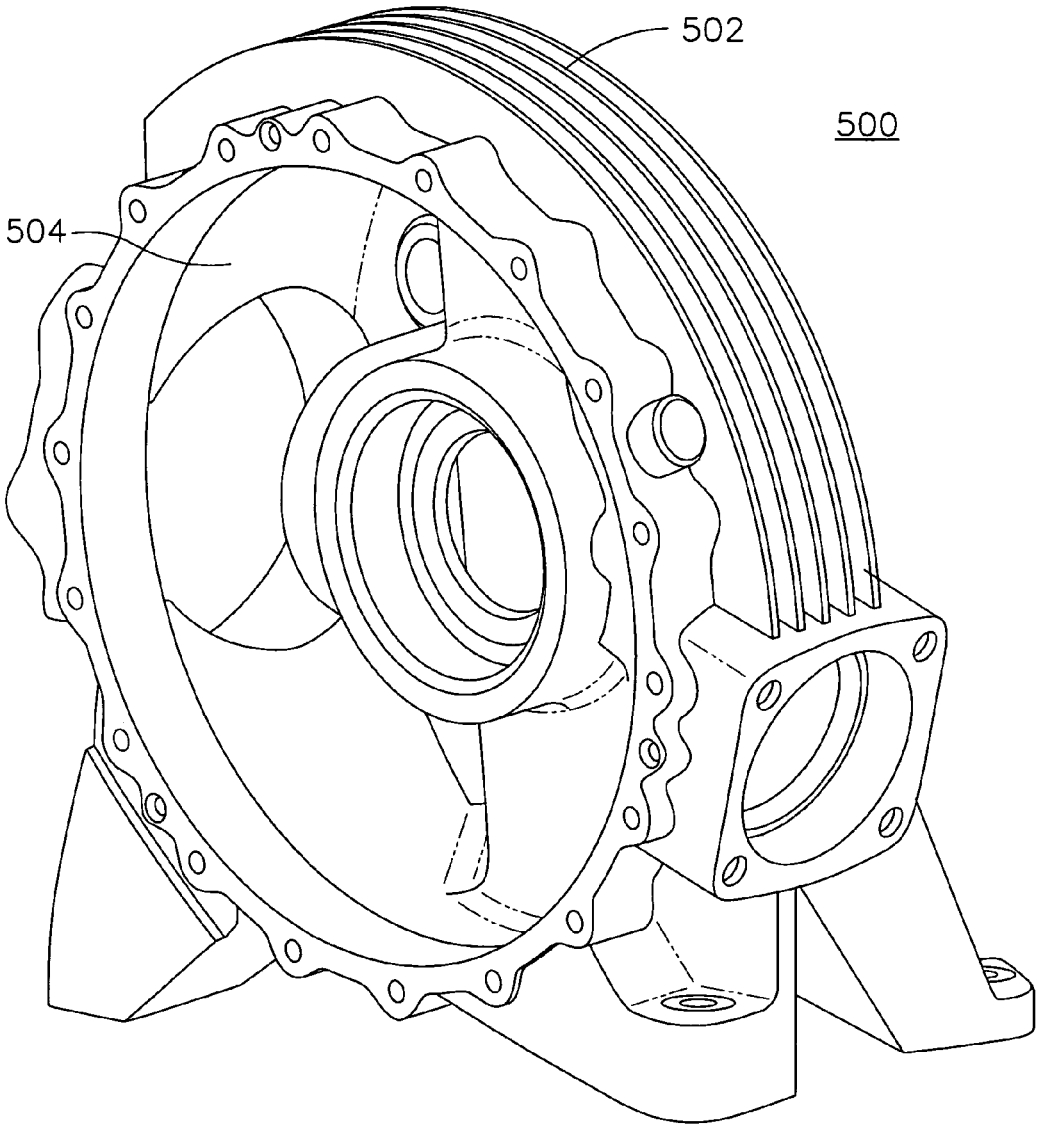
FIG. 5 is a perspective view of a housing assembly for a tail rotor gearbox for an Apache helicopter, on which the process of the present invention may be utilized.

FIG. 5 is a perspective view of a housing assembly for a tail rotor gearbox 500 for an Apache helicopter, on which the process of one embodiment of the present invention may be utilized. The magnesium or magnesium alloy housing assembly for the tail rotor gearbox 500 may be used for a helicopter such as the AH-64 Apache helicopter utilized by the U.S. Army. Shown in FIG. 5 may be an outer surface 502 that undergoes the corrosion resistance treatment process as described in FIG. 3. Also shown may be an inner surface 504 that may be exposed during the disassembly step 204 of FIG. 2 wherein the magnesium parts or components may be disassembled, fluorescent or liquid penetrant inspected, and structurally repaired. In the case of a tail-rotor gearbox for an Apache helicopter, all parts of the gearbox structure 500 may be disassembled so as to expose those areas of the gearbox affected by corrosion and slated for corrosion resistance treatment. Inner surface 504 also undergoes the corrosion resistance treatment process as described in FIG. 3.

It should be understood, of course, that the foregoing relates to exemplary embodiments of the invention and that modifications may be made without departing from the spirit and scope of the invention as set forth in the following claims.

I claim:

1. A method for protecting a magnesium element from corrosion, comprising:

removing corrosion from the magnesium element by applying a chromic pickle to the magnesium element;

applying a chromate layer to a surface of the magnesium element;

applying an adhesion promoter over the chromate layer; and applying an organic coating over the adhesion promoter such that the adhesion promoter provides adhesion between the chromate layer and the organic coating.

2. A method for protecting a magnesium element from corrosion, comprising:

removing corrosion from the magnesium element by scraping corroded elements from the magnesium element;

applying a chromate layer to a surface of the magnesium element;

applying an adhesion promoter over the chromate layer; and applying an organic coating over the adhesion promoter such that the adhesion promoter provides adhesion between the chromate layer and the organic coating.

3. A method for protecting a magnesium element composed of magnesium or magnesium alloy, the magnesium element comprising a gearbox for a vehicle, from corrosion, the method comprising:

applying a chromate layer to a surface of the magnesium element;

applying an adhesion promoter over the chromate layer; and applying an organic coating over the adhesion promoter such that the adhesion promoter provides adhesion between the chromate layer and the organic coating.

4. A method for protecting a vehicle gearbox composed of magnesium or magnesium alloy from corrosion, comprising:

removing corrosion and paint from the gearbox;

immersing the gearbox in a chromate solution so as to create a chromate layer on a surface of the gearbox;

applying an adhesion promoter over the chromate layer on the surface of the gearbox; and applying an organic coating over the adhesion promoter wherein the adhesion promoter provides adhesion between the chromate layer and the organic coating.

5. The method of claim 4, wherein said removing step includes:

removing corrosion and paint from the gearbox by applying a chromic pickle to the gearbox.

6. The method of claim 4, wherein said removing step includes:

removing corrosion and paint from the gearbox by scraping corroded elements from the gearbox using an abrasive pad.

7. The method of claim 4, wherein the second step of applying comprises:

applying an adhesion promoter over the chromate layer, wherein the adhesion promoter fills in at least one of any cracks that exist in the chromate layer on the surface of the gearbox.

8. The method of claim 4, wherein said step of applying an organic coating includes:

applying a resin seal organic coating over the adhesion promoter by spraying or immersing the magnesium element with a resin seal organic coating, wherein the adhesion promoter provides adhesion between the chromate layer and the resin seal organic coating.

9. The method of claim 4, wherein the second step of applying comprises:

applying a waterproof organic coating over the adhesion promoter wherein the adhesion promoter provides adhesion between the chromate layer and the organic coating.

10. The method of claim 4, wherein the method for protecting a vehicle gearbox composed of magnesium or magnesium alloy from corrosion comprises protecting a helicopter gearbox composed of magnesium or magnesium alloy from corrosion.

* * * * *